US006190851B1

(12) United States Patent
Harder et al.

(10) Patent No.: US 6,190,851 B1
(45) **Date of Patent: *Feb. 20, 2001**

(54) PHOTOGRAPHIC ELEMENT, DISPERSION, COMPOUND AND PROCESS

(75) Inventors: John W. Harder, Rochester; James S. Honan, Spencerport; Albert J. Mura, Rochester, all of NY (US)

(73) Assignee: Eastman Kodak Company, Rochester, NY (US)

( * ) Notice: Under 35 U.S.C. 154(b), the term of this patent shall be extended for 0 days.

This patent is subject to a terminal disclaimer.

(21) Appl. No.: 09/473,790

(22) Filed: Dec. 28, 1999

(51) Int. Cl.[7] ..... G03C 1/08; G03C 7/26; G03C 7/32

(52) U.S. Cl. ..... 430/553; 430/552; 430/384; 430/385

(58) Field of Search ..... 430/543, 552, 430/553, 384, 385

(56) References Cited

U.S. PATENT DOCUMENTS

| | | | | |
|---|---|---|---|---|
| 4,609,619 | | 9/1986 | Katoh et al. . | |
| 4,775,616 | | 10/1988 | Kilminster et al. . | |
| 4,849,328 | | 7/1989 | Hoke et al. . | |
| 5,008,180 | | 4/1991 | Merkel et al. . | |
| 5,045,442 | | 9/1991 | Hoke . | |
| 5,183,729 | | 2/1993 | Naito et al. . | |
| 5,378,596 | | 1/1995 | Naruse et al. . | |
| 5,674,666 | * | 10/1997 | Lau et al. | 430/384 |
| 5,681,690 | | 10/1997 | Tang et al. . | |
| 5,686,235 | | 11/1997 | Lau et al. . | |
| 5,888,716 | * | 10/1999 | Edwards et al. | 430/549 |
| 5,962,198 | * | 10/1999 | Lau et al. | 430/553 |
| 6,048,674 | * | 10/1999 | McInerney et al. | 430/384 |
| 6,110,658 | * | 8/2000 | Honan et al. | 430/553 |

FOREIGN PATENT DOCUMENTS

59/111645 6/1984 (JP) .

OTHER PUBLICATIONS

JO 2035–450–A–Konica–Abstract—Feb. 6, 1990.
JO 1253–742–A–Konica–Abstract—Oct. 11, 1989.
JP 04163448–A–Konica–Abstract—Jun. 9, 1992.
JP 04212152–A–Fuji–Abstract—Aug. 3, 1992.
J5 9111–645–A–Konishiroku–Abstract.

* cited by examiner

*Primary Examiner*—Geraldine Letscher
(74) *Attorney, Agent, or Firm*—Arthur E. Kluegel

(57) ABSTRACT

Disclosed is a photographic element complising a light sensitive silver halide emulsion layer having associated therewith a cyan dye forming coupler having Formula (I):

(I)

wherein $R_1$ and $R_3$ independently represent hydrogen or an alkyl group;

$R_2$ represents a carbocyclic or heterocyclic aromatic group;

n represents 1, 2, or 3;

each X is an independently selected substituent where at least one X located at a position of the phenyl ring meta or para to the sulfonyl group and is either an alkoxy group having a branched carbon or an aiyloxy group; and Z represents hydrogen or a group that can be split off by the reaction of the coupler with an oxidized color-developing compound;

provided that the substituents of the compound of formula (I) are selected so that the compound has a melting point of 160° C. or less.

The element provides improved phase stability during manufacturing while exhibiting satisfactory hue and dye light stability.

21 Claims, No Drawings

PHOTOGRAPHIC ELEMENT, DISPERSION, COMPOUND AND PROCESS

FIELD OF THE INVENTION

The present invention relates to a silver halide color photographic element containing a dispersion of a paiticular type of phenolic cyan dye-forming coupler bearing a paiticular sulfone containing 5-substituent. The invention also is directed to the compound itself, and to an imaging process employing the element.

BACKGROUND OF THE INVENTION

In silver halide based color photography, a typical photographic element contains multiple layers of light-sensitive photographic silver halide emulsions coated on a support with one or more of these layers being spectrally sensitized to each of blue light, green light and red light. The blue, green, and red light-sensitive layers typically contain yellow, magenta, and cyan dye-foiming couplers, respectively. After exposure to light, color development is accomplished by immersing the exposed material in an aqueous alkaline solution containing an aromatic primaly amine color-developing compound. The dye-forming couplers are selected so as to react with the oxidized color developing agent to provide yellow, magenta and cyan dyes in the so called subtractive color process to reproduce their complementary colors, blue, green and red as in the original image.

The important features for selecting the dye-foiming coupler include: efficient reaction with oxidized color developing agent, thus minimizing the necessary amounts of coupler and silver halide in the photographic element; formation of dyes with hues appropriate for the photographic use of interest (for color photographic paper applications this requires that dyes have low unwanted side absorption leading to good color reproduction in the photographic print); minimization of image dye loss contributing to improved image permanence under both ambient illumination and conventional storage conditions; and, in addition, low crystallization tendency, and thus good solubility in coupler solvents and good dispersibility in gelatin during handling and manipulation for improved efficiency in manufacturing processes.

In recent years, a great deal of study has been conducted to improve dye-forming couplers for silver halide photosensitive materials in terms of improved color reproducibility and image dye stability. However, further improvements are needed, palticularly in the area of cyan couplers. In general, cyan dyes are formed from naphthols and phenols as described, for example, in U.S. Pat. Nos. 2,367,351, 2,423,730, 2,474,293, 2,772,161, 2,772,162, 2,895,826, 2,920,961, 3,002,836, 3,466,622, 3,476,563, 3,552,962, 3,758,308, 3,779,763, 3,839,044, 3,880,661, 3,998,642, 4,333,999, 4,990,436, 4,960,685, and 5,476,757; in French patents 1,478,188 and 1,479,043; and in British patent 2,070,000. These types of couplers can be used either by being incorporated in the photographic silver halide emulsion layers or externally in the processing baths. In the former case the couplers must have ballast substituents built into the molecule to prevent the couplers migrating from one layer into another. Although these couplers have been used extensively in color photographic film and paper products, the dyes derived from them still suffer from poor stability to heat, humidity or light, low coupling efficiency or optical density, and in particular from undesirable blue and green absoptions which cause considerable reduction in color reproduction and color saturation.

Cyan couplers which have been recently proposed to overcome some of these problems are 2,5-diacylaminophenols containing a sulfone, sulfonamido or sulfate moiety in the ballasts at the 5-position, as disclosed in U.S. Pat. Nos. 4,609,619, 4,775,616, 4,849,328, 5,008,180, 5,045,442, and 5,183,729, and Japanese patent applications JP02035450 A2, JP01253742 A2, JP04163448 A2, JP04212152 A2, and JP05204110 A2. Even though cyan image dyes formed from these couplers show improved stability to heat and humidity, enhanced optical density and resistance to reduction by ferrous ions in the bleach bath, the dye absorption maxima ($\lambda$max) are too hypsochromically shifted (that is, shifted to the blue or short wavelength side of the visible spectrum) and the absorption spectra are too broad with considerable amounts of undesirable blue and green absorptions and often lack sufficient stability toward light fading. Thus, these couplers are not as desired for use in color papers.

The hue of a dye is a function of both the shape and the position of its spectral absoiption band. Traditionally, the cyan dyes used in color photographic papers have had nearly symmetrical absorption bands centered in the region of 620 to 680 nm, typically 630 to 660 nm, and more often 635 to 655 nm. Such dyes have rather large amounts of unwanted absorption in the green and blue regions of the spectrum.

More desirable would be a dye whose absorption band is asymmetrical in nature and biased towards the green region, that is, with a steep slope on the short wavelength side. Such a dye would suitably peak at a shoiter wavelength than a dye with symmetrical absorption band, but the exact position of the desired peak depends on several factors including the degree of asymmetry and the shapes and positions of the absorption bands of the magenta and yellow dyes with which it is associated.

Recently, Lau et al., in U.S. Pat. No. 5,686,235, describe a particular class of cyan dye-forming coupler that has been shown to improve thermal stability and hue, particularly with decreased absorption in side bands and an absorption band that is asymmetrical in nature. However, it has been found that dispersions of these couplers are difficult to prepare free of crystalline material, and are not phase stable with time in cold storage. Other related patents are U.S. Pat. Nos. 5,047,314, 5,047,315, 5,057,408, and 5,162,197.

Large-scale manufacturing of photographic materials can be severely hindered when crystalline material is present in dispersions and coating melts of such dispersions. This can lead to difficulty in manufacturing by plugging filters and causing defects in coatings of photographic materials. It is therefore desirable to use dispersions which have few, if any, crystals and are stable in cold storage from the time of preparation until the time of use.

This invention relates to a selection of cyan coupler that is a narrow-bandwidth or "NB coupler" which is defined more fully hereinafter. It has been found that preparing substantially crystal free dispersions of these "NB couplers" can be difficult. It appears that the property of these couplers that enables the dye formed by them to shift hue may at the same time be responsible for difficulties in the formation of unwanted crystals. Appropriate selection of a coupler solvent can reduce the amount of crystals. However, it has been found that some "NB couplers", particularly those with high melting points, can fail to disperse in these preferred solvents as cleanly as couplers of lower melting points.

The use of various high boiling coupler solvents is disclosed in the following U.S. patents: U.S. Pat. No. 5,726,003, U.S. Pat. No. 5,047,315, U.S. Pat. No. 5,057,408, U.S. Pat. No. 5,356,768, U.S. Pat. No. 4,882,267, U.S. Pat. No. 4,767,697, U.S. Pat. No. 4,217,410, and U.S. Pat. No. 4,840,878. Experimental work contained in this specification has shown that a number of these known solvents may be employed to reduce the amount of crystals formed, but these solvents also result in decreased coupler reactivity and increased unwanted green light absorption.

Combinations of couplers close in structure has been used to inhibit the crystal foiming tendency of these couplers since mixtures of solids often exhibit lower melting points than single substances. However for large-scale synthesis it is desirable to prepare a single coupler that has all of the desired performance features.

The problem to be solved is to provide a photographic element and process employing a dispersion containing a phenolic cyan coupler that exhibits reduced crystal formation and at the same time provides desired hue and light stability.

SUMMARY OF THE INVENTION

The invention provides a photographic element comprising a light sensitive silver halide emulsion layer having associated therewith a cyan dye forming coupler having Formula (I):

(I)

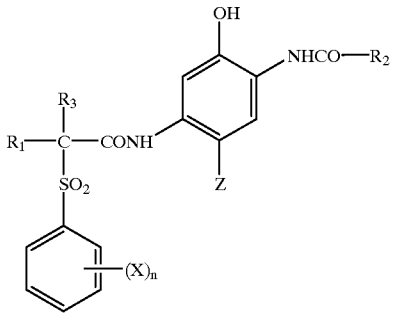

wherein $R_1$ and $R_3$ independently represent hydrogen or an alkyl group;

$R_2$ represents a carbocyclic or heterocyclic aromatic group;

n represents 1, 2, or 3;

each X is an independently selected substituent where at least one X located at a position of the phenyl ring meta or para to the sulfonyl group and is either an alkoxy group having a branched carbon or an aryloxy group; and Z represents hydrogen or a group that can be split off by the reaction of the coupler with an oxidized color-developing compound;

provided that the substituents of the compound of formula (I) are selected so that the compound has a melting point of 160° C. or less.

The invention also provides a coupler compound and a process for forming an image in the element of the invention.

Advantageously, the photographic element exhibits reduced crystal formation and at the same time provides desired hue and light stability.

DETAILED DESCRIPTION OF THE INVENTION

As described in the summaly of the Invention, the invention provides a photographic element complising a light sensitive silver halide emulsion layer having associated therewith a cyan dye foiming coupler having Formula (I):

(I)

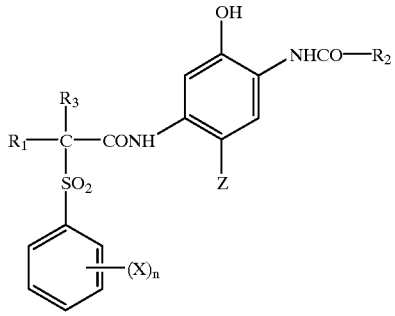

wherein $R_1$ and $R_3$ independently represent hydrogen or an alkyl group;

$R_2$ represents a carbocyclic or heterocyclic aromatic group;

n represents 1, 2, or 3;

each X is an independently selected substituent where at least one X located at a position of the phenyl ring meta or para to the sulfonyl group and is either an aiyloxy group of an alkoxy group having a branched carbon; and Z represents hydrogen or a group that can be split off by the reaction of the coupler with an oxidized color-developing compound, provided that the substituents of the compound of formula (I) are selected so that the compound has a melting point of 160° C. or less.

$R_1$ and $R_3$ are selected independently of each other and may both be hydrogen, or both alkyl of a combination. Alkyl groups may be substituted as indicated hereinafter. Usually, one of these substituents is a C1 to C4 alkyl group and is unsubstituted.

$R_2$ is suitably a phenyl, naphthyl or heterocyclic aromatic ring group. Heterocyclic examples include those based on pyridine and pyrazole. In the case of a phenyl group, it is desirable to have an electron withdrawing substituent in a position meta or para to the amide group. Such groups have a positive Hammett's sigma value corresponding to the location of the substituent relative to the amide group. Such values are given, for example, in Hansch and Leo, "Substituent Constants for Correlation Analysis in Chemistry and Biology" Wiley, New York, 1979. Suitable examples are chloro, cyano, fluoro, sulfonyl, and sulphonamido groups.

n is an integer of 1 to 3. Each X is an independently selected substituent, with at least one X located at a position of the phenyl ring meta or para to the sulfonyl group being either an aiyloxy group of an alkoxy group having a branched carbon. Suitable aryloxy groups are phenoxy and substituted phenoxy, such as those containing an alkyl or amino substituent. Suitable alkoxy groups are those containing any branched carbon, particularly in the β position.

Z is suitably hydrogen or a coupling-off group such as halogen, aryloxy, alkoxy, arylthio, alkylthio, or heterocyclic groups. These are more fully described hereinafter.

The melting point of the coupler is 160° C. or less and more desirably 150° C. or less. This provides better phase stability.

Specific examples of couplers useful in the invention are as follows:

IC-1
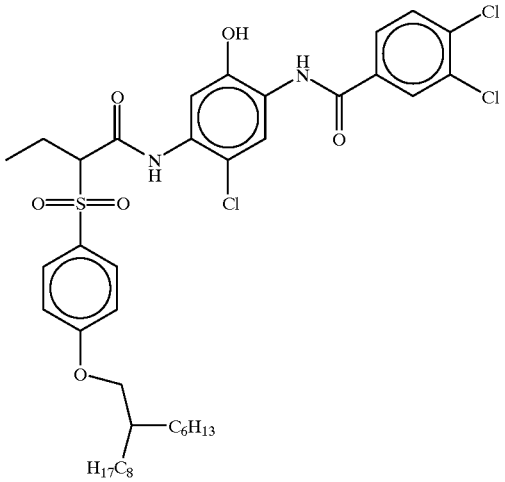
IC-2
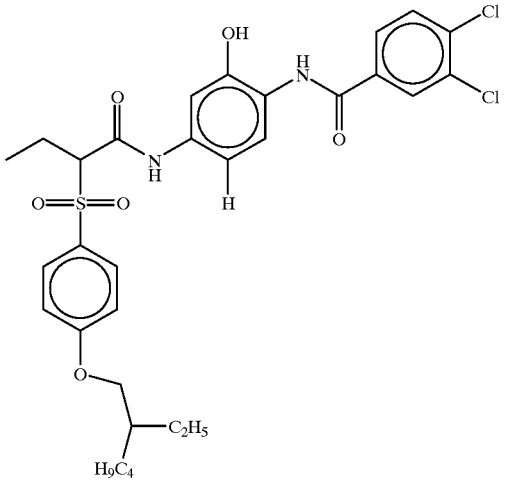
IC-3
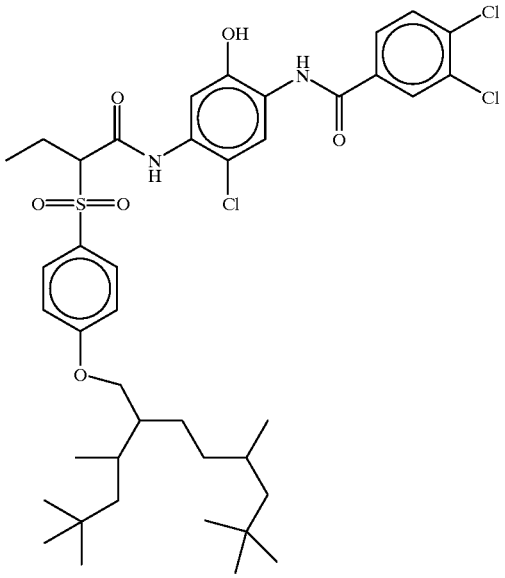
-continued
IC-4
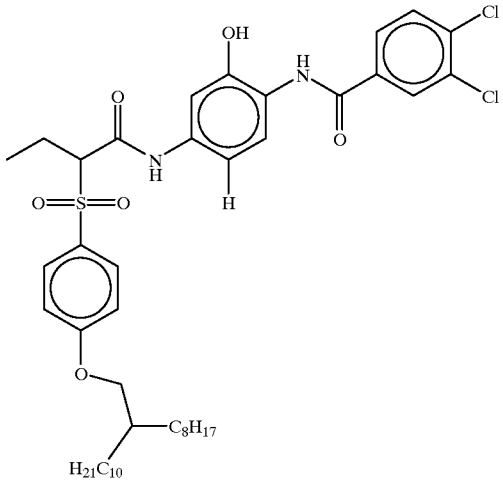
IC-5
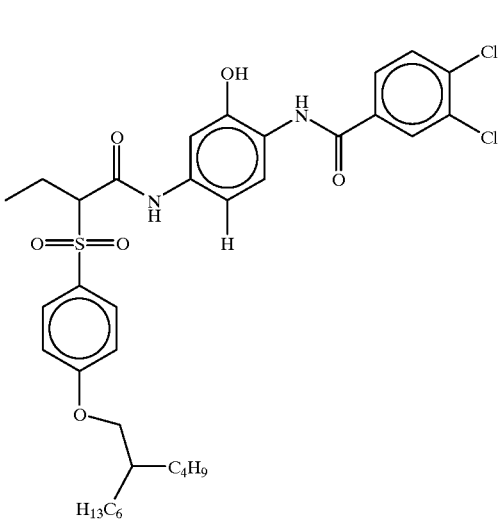
IC-6
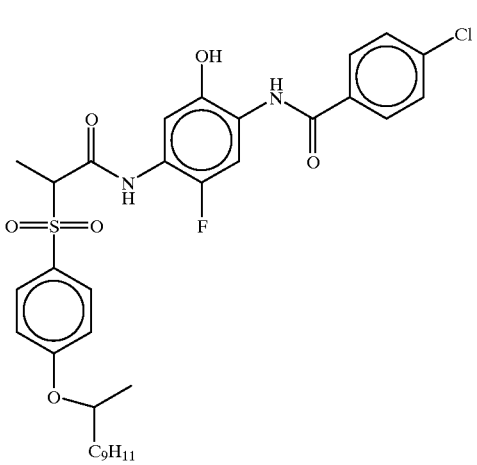

-continued
IC-7
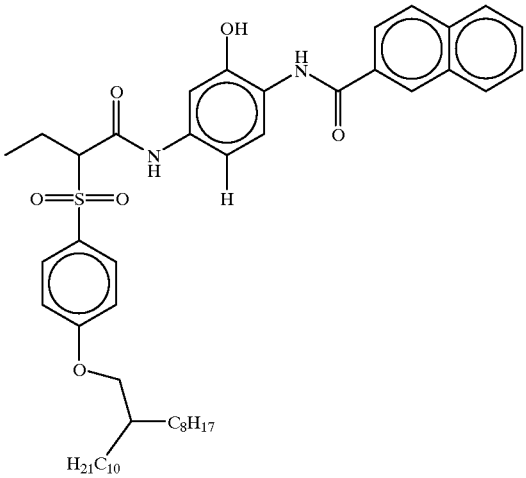
IC-8
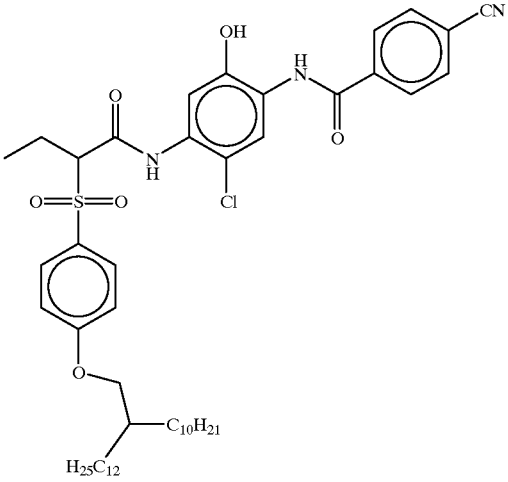
IC-9
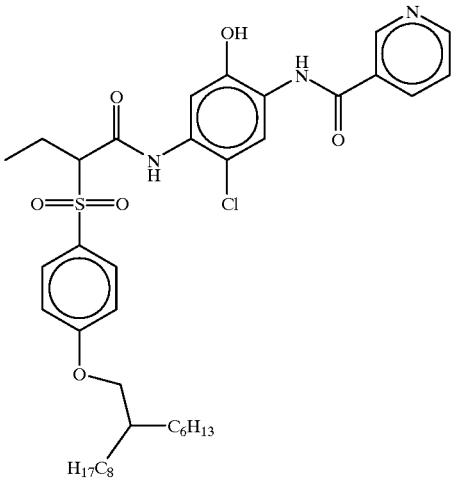
-continued
IC-10
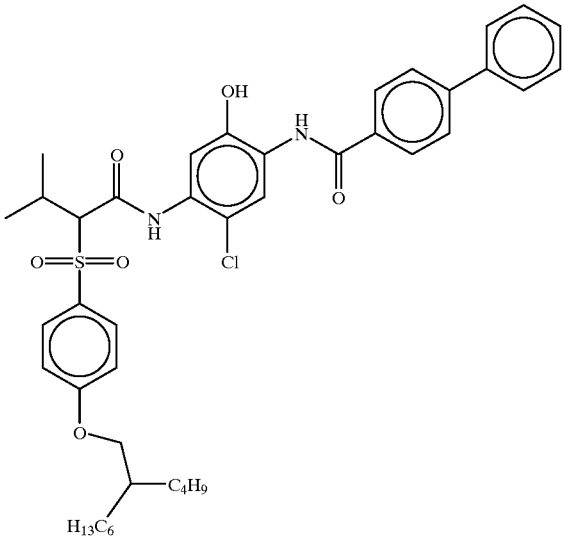
IC-11
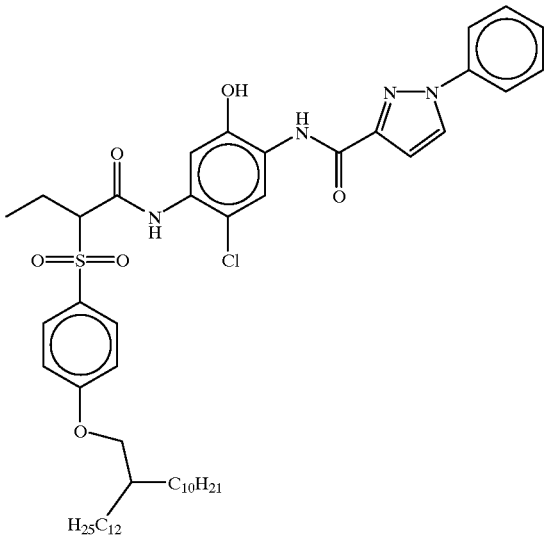

-continued
IC-12
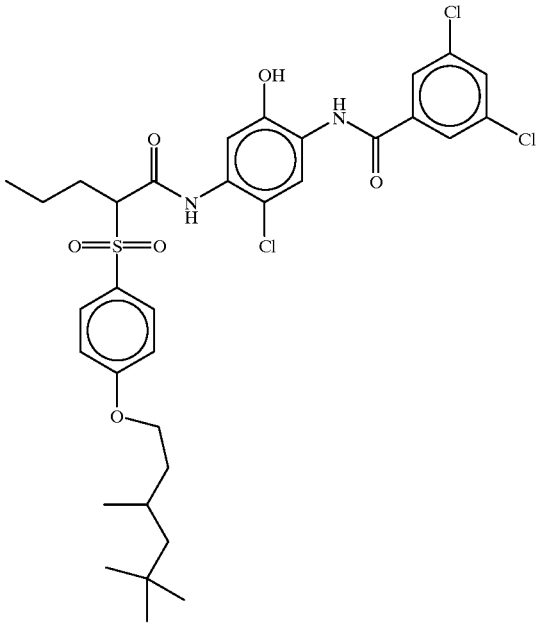
IC-13
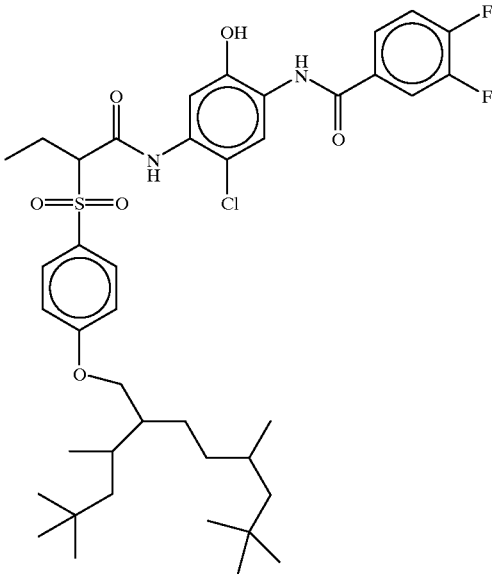
-continued
IC-14
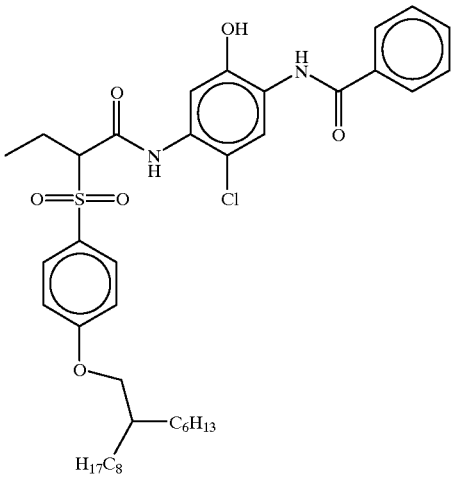
IC-15
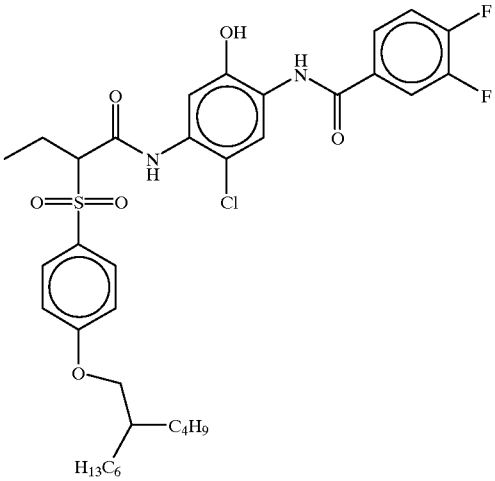
IC-16
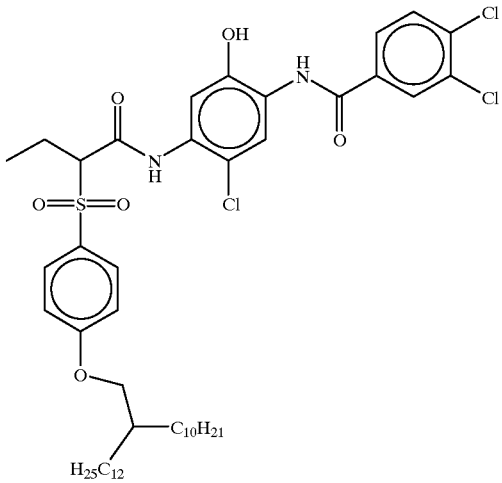

-continued

IC-17

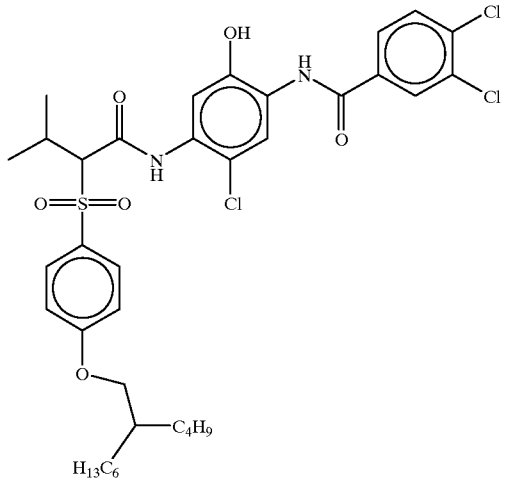

IC-18

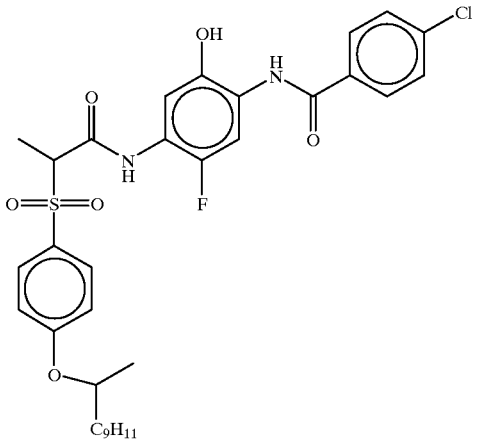

IC-19

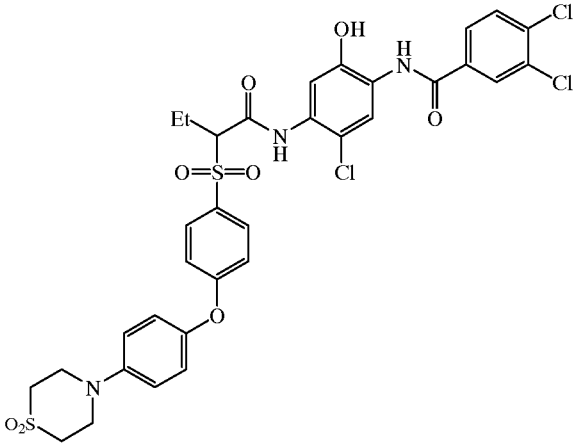

-continued

IC-20

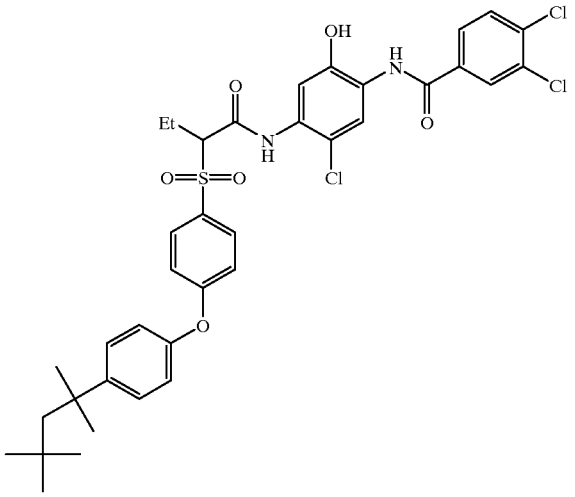

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aiyloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido. N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetiadecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternaly ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a melt and coated as a layer described herein on a support to form part of a photographic element. When the term "associated" is employed, it signifies that a reactive compound is in or adjacent to a specified layer where, during processing, it is capable of r eacting with other components.

To control the migration of valious components, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 40 carbon atoms. Such substituents can also be fuilher substituted.

The photographic elements can be single color elements or multicolor elements. Multicolor elements contain image dye-foiming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative foimat, the emulsions sensitive to each of the three primary regions of the spectrum can be disposed as a single segmented layer.

A typical multicolor photographic element complises a support bearing a cyan dye image-foirming unit comprised of at least one red-sensitive silver halide emulsion layer having associated therewith at least one cyan dye-forming coupler, a magenta dye image-foiming unit comprising at least one green-sensitive silver halide emulsion layer having associated therewith at least one magenta dye-foiming coupler, and a yellow dye image-foiming unit comprising at least one blue-sensitive silver halide emulsion layer having associated therewith at least one yellow dye-foiming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12*a* North Street, Emswolth, Hampshire P010 7DQ, ENGLAND, or as described in Hatsumi Kyoukai Koukai Gihou No. 94-6023, published Mar. 15, 1994, available from the Japanese Patent Office, the contents of which are incorporated herein by reference.

In the following discussion of suitable materials for use in the emulsions and elements of this invention, reference will be made to *Research Disclosure*, September 1996, Item 38957, available as described above, which will be identified hereafter by the term "Research Disclosure". The contents of the Research Disclosure, including the patents and publications referenced therein, are incorporated herein by reference, and the Sections hereafter refelTed to are Sections of the Research Disclosure.

The silver halide emulsions employed in the elements of this invention can be either negative-working or positive-working. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. Certain desirable photographic elements and processing steps are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350, German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848, 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color-developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color-developing agent.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629.

Typically, couplers are incorporated in a silver halide emulsion layer in a mole ratio to silver of 0.1 to 1.0 and generally 0.1 to 0.5. Usually the couplers are dispersed in a high-boiling organic solvent in a weight ratio of solvent to coupler of 0.1 to 10.0, typically 0.1 to 2.0 and usually 0.1 to 0.6, although direct dispersions are sometimes employed.

The invention materials may also be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097, 140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

It is contemplated that the concepts of the present invention may be employed to obtain reflection color prints as described in *Research Disclosure*, November 1979, Item 18716, available from Kenneth Mason Publications, Ltd, Dudley Annex, 12*a* North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072, 633; 90-072,634; 90-077,822; 90-078,229; 90-078,230; 90-079,336; 90-079,337; 90-079,338; 90-079,690; 90-079, 691; 90-080,487; 90-080,488; 90-080,489; 90-080,490; 90-080,491; 90-080,492; 90-080,494; 90-085,928; 90-086, 669; 90-086,670; 90-087,360; 90-087,361; 90-087,362; 90-087,363; 90-087,364; 90-088,097; 90-093,662; 90-093, 663; 90-093,664; 90-093,665; 90-093,666; 90-093,668; 90-094,055; 90-094,056; 90-103,409; 83-62,586; 83-09, 959.

Conventional radiation-sensitive silver halide emulsions can be employed in the practice of this invention. Such emulsions are illustrated by *Research Disclosure*, Item 38755, September 1996, I. Emulsion grains and their preparation.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435, 501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061, 609, Tsaur et al U.S. Pat. Nos. 5,147,771, '772, '773, 5,171,659 and 5,252,453, Black et al 5,219,720 and 5,334, 495, Delton U.S. Pat. Nos. 5,310,644, 5,372,927 and 5,460, 934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride{111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320, 938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-foiming emulsions, or direct-positive emulsions of the unfogged, internal latent image-foirming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color-developing agent to reduce developable silver halide and oxidize the color-developing agent. Oxidized color developing agent in turn reacts with the coupler to yield a dye. If desired "Redox Amplification" as described in Research Disclosure XVIII-B(5) may be used.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

Another type of color negative element is a color print. Such an element is designed to receive an image optically printed from an image capture color negative element. A color print element may be provided on a reflective suppolt for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The print may then be processed to form a positive reflection image using, for example, the Kodak RA-4 process as generally described in PCT WO 87/04534 or U.S. Pat. No. 4,975,357. Color projection prints may be processed, for example, in accordance with the Kodak ECP-2 process as described in the H-24 Manual. Similarly, back-lit image transparencies may be prepared for display purposes. Color print development times are typically 90 seconds or less and desirably 45 or even 30 seconds or less.

The above emulsions are typically sold with instructions to process using the appropriate method such as the mentioned color negative (Kodak C-41), color print (Kodak RA-4), or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamido-ethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach fixing to remove silver or silver halide, washing, and drying.

SYNTHESIS SCHEME AND EXAMPLE

Scheme

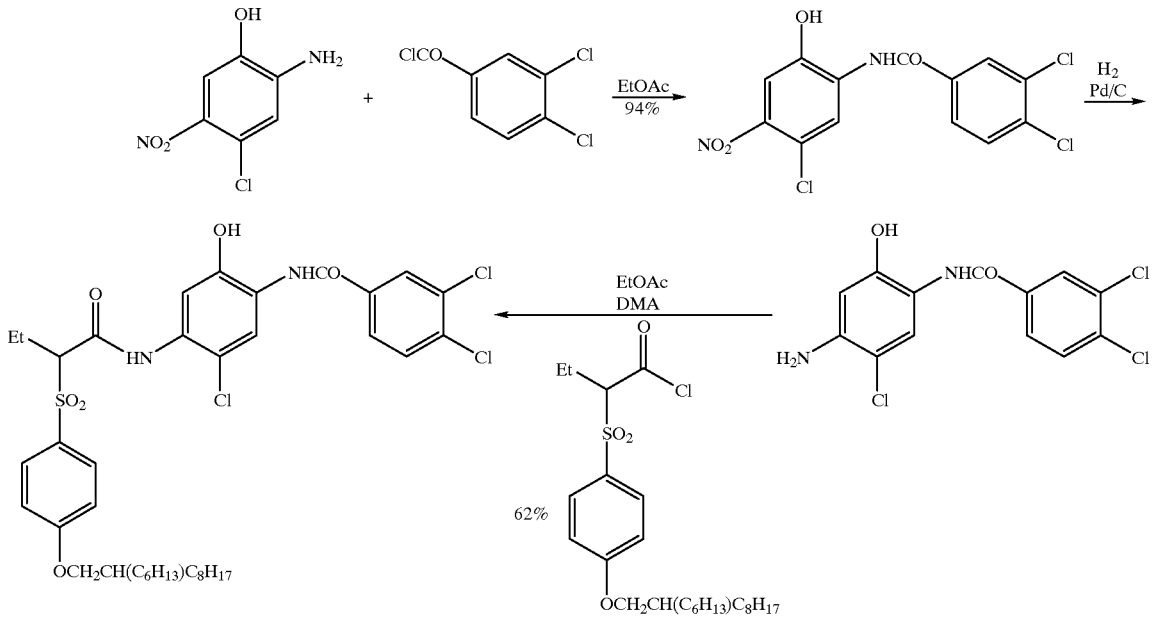

-continued

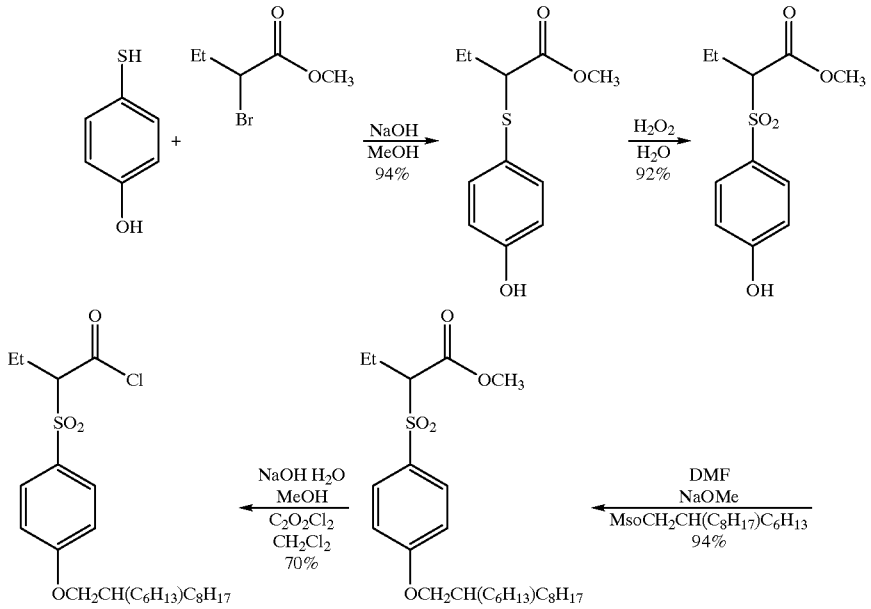

Synthesis Example

Synthesis of Ballast Acid Chloride 4-mercaptophenol (12.6 g, 0.1 mol) and methyl-2-bromobutyl-ate (18.2 g, 0.1 mol) were mixed in methanol (100 ml) and sodium hydroxide pellets (4.0 g, 0.1 mol) were added. The reaction was stilTed overnight under nitrogen at RT and concentrated. The residue was partitioned between ethyl acetate and 10% aqueous hydrochloric acid. The organic layer was dried ($MgSO_4$) and concentrated to yield the desired phenol in 94% yield.

Methyl (2-(4-hydroxyphenylthio))butyrate (22.6 g, 0.1 mol) was mixed with water (100 ml) and was heated to reflux. The heat was removed and a 30% hydrogen peroxide solution (34 g, 0.4 mol) was added dropwise. After the addition the mixture was heated at reflux overnight. The solution was partitioned between ethyl acetate and water. The ethyl acetate layer was dried ($MgSO_4$) and concentrated. The product was recrystallized using a 1:1 mixture of diethyl ether and heptane to yield the desired product in 92% yield.

Methyl (2-(4-hydroxyphenylsulfonyl))butyrate (25.8 g 0.1 mol), sodium methoxide in methanol (21.6 g, 0.1 mol), and the mesylate of 2-hexyldecanol (32 g, 0.1 mol) in dimethylforiamide (100 ml) was heated at reflux overnight. The residue was partitioned between ethyl acetate and 10% aqueous hydrochloric acid. The organic layer was washed with water and dried ($MgSO_4$) and concentrated to give the desired ballast ester in 94% yield.

The ballast ester (48.3 g, 0.1 mmol) was mixed with methanol (100 ml) and water (30 ml) and treated with aqueous 50% sodium hydroxide (16 g, 0.2 mol) and stirred at RT for 1 hr. The solution was acidified with concentrated HCl and resulting mixture was paititioned between ethyl acetate and water. The organic layer was dried and concentrated. The residue was dissolved in dichloromethane and treated with oxalyl chloride (14 g, 0.11 mol) and a few drops of dimethylformamide and the reaction was stirred at RT for 3 hrs and concentrated to yield the ballast chloride in 70% yield.

Synthesis of the Coupler

2-Amino-4-chloro-5-nitrophenol (18.9 g, 0.1 mol) and 3,4-dichlorobenzoyl chloride (20.9 g, 0.1 mol) were mixed in ethyl acetate (300 ml) and heated to reflux for 5 hrs. The solution was filtered and the solid was collected and washed with ethyl acetate to give the desired product in 94% yield.

2-(3,4-dichlorobenzoylamido)-4-chloro-5-nitrophenol (36 g, 0.1 mol) was mixed tetrahydiofuran (75 ml) and 10% palladium on carbon (0.1 g) and shaken with hydrogen gas on a PaiT Shaker overnight. The reaction was filtered and concentrated to a solid. 2-(3,4-dichlorobenzoylamido)-4-chloro-5-aminophenol (33.1, 0.1 mol), and N,N dimethylaniline (12.1 g, 0.1 mol) were dissolved in tetrahydrofuran (100 ml) and treated dropwise with a solution of the ballast acid chloride (48.7 g, 0.1 mol) and the reaction was stilted for 2 hrs. The reaction was partitioned between ethyl acetate and aqueous 10% hydrochloric acid and the organic layer was dried ($MgSO_4$) and concentrated. The residue was recrystallized from methanol to give the desire product in 62% yield.

Photographic Examples

Preparation of Photographic Elements

Coupler IC-1, stabilizer ST-1, and coupler solvent dibutyl sebacate were dispersed in aqueous gelatin in the following manner. Coupler IC-1 (0.658 g, 8.4×10 −4 mole) and stabilizer ST-1 (0.444 g, $1.26\times10^{-3}$ mole) were dissolved in dibutyl sebacate (0.658 g) and ethyl acetate (1.975 g). The mixture was heated to effect solution. After adding a solution of aqueous gelatin (22.58 g, 11.6% solution), diisopropylnaphthalene sulfonic acid (sodium salt) (2.60 g, 10% solution), and water to make a total of 39.31 grams, the mixture was dispersed by passing it three times through a Gaulin homogenizer. This dispersion was used in the preparation of photographic element 101.

Dispersions containing the couplers shown for elements in Table 1 were prepared in a similar manner except that the IC-1 was omitted and coupler indicated was used in its place.

The photographic elements were prepared as follows:

On a gel-subbed, polyethylene-coated paper support were coated the following layers:

First Layer

An underlayer containing 3.23 grams gelatin per square meter.

Second Layer

A photosensitive layer containing (per square meter) 2.15 grams total gelatin, an amount of green-sensitized silver chloride emulsion containing 0.194 grams silver; the dispersion containing $5.38\times10^{-4}$ mole of the coupler indicated in Table 1; and 0.043 gram surfactant Alkanol XC (trademark of E. I. Dupont Co.)(in addition to the Alkanol XC used to prepare the coupler dispersion Third Layer A protective layer containing (per square meter) 1.40 grams gelatin, 0.15 gram bis(vinylsulfonyl)methyl ether, 0.043 gram Alkanol XC, and $4.40\times10^{-6}$ gram tetraethylammonium perfluorooctanesulfonate.

Preparation of Processed Photographic Examples

Processed samples were prepared by exposing the coatings through a step wedge and processing as follows:

| Process Step | Time (min.) | Temp. (° C.) |
|---|---|---|
| Developer | 0.75 | 35.0 |
| Bleach-Fix | 0.75 | 35.0 |
| Water wash | 1.50 | 35.0 |

The processing solutions used in the above process had the following compositions (amounts per liter of solution):

| | |
|---|---|
| Developer | |
| Triethanolamine | 12.41 g |
| Blankophor REU (trademark of Mobay Corp.) | 2.30 g |
| Lithium polystyrene sulfonate | 0.09 g |
| N,N-Diethylhydroxylamine | 4.59 g |
| Lithium sulfate | 2.70 g |
| 4-amino-3-methyl-N-ethyl-N-(2-methansulfonamidoethyl)aniline sesquisulfate hydrate | 5.00 g |
| 1-Hydroxyethyl-1,1-diphosphonic acid | 0.49 g |
| Potassium carbonate, anhydrous | 21.16 g |
| Potassium chloride | 1.60 g |
| Potassium bromide | 7.00 mg |
| pH adjusted to 10.4 at 26.7 C | |
| Bleach-Fix | |
| Solution of ammonium thiosulfate | 71.85 g |
| Ammonium sulfite | 5.10 g |
| Sodium metabisulfite | 10.00 g |
| Acetic acid | 10.20 g |
| Ammonium ferric ethylenediaminetetra acetate | 48.58 g |
| Ethylenediaminetetraacetic acid | 3.86 g |
| pH adjusted to 6.7 at 26.7 C | |

TABLE II

| Coupler | Type | Melting Point -° C. | LBW (λmax) -nm | Light Fade from 1.0* |
|---|---|---|---|---|
| CC-1 | Comp | 165–167 | 47.1(633.2) | -.14 |
| CC-2 | Comp | 161–162 | 46.5(631.5) | -.14 |
| CC-3 | Comp | 96–98 | 63.5 (633.8) | -.29 |
| CC-4 | Comp | 138–139 | 84.4 (660.7) | -.13 |
| CC-5 | Comp | 140–141 | 60.6 (641.3) | -.17 |
| CC-6 | Comp | 166–167 | 50.9 (629.6) | -.21 |
| IC-1 | Inv | 146–147 | 47.2 (632.2) | -.11 |
| IC-2 | Inv | 152–153 | 56.5 (632.8) | -.11 |
| IC-3 | Inv | 100–102 | 45.8 (628.5) | -.11 |
| IC-4 | Inv | 149–150 | 49.6 (631.7) | -.09 |
| IC-5 | Inv | 140–142 | 51.9 (634.0) | -.08 |

*Loss of density from 1.0 after 4 wks at 50 Klux

Comparatives 1, 2, and 6 have melting points that are too high for desired ciystal/solution stability. Comparatives 3–6 exhibit undesirable bandwidth, hue, and/or dye light stability.

Comparative Couplers

CC-1

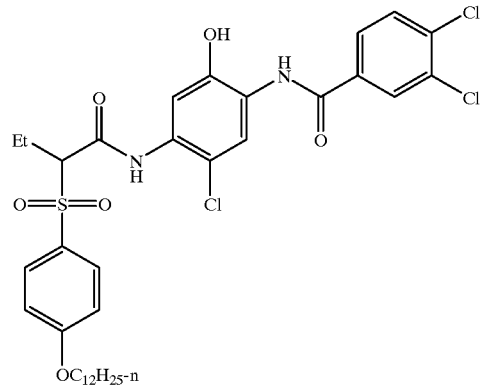

CC-2

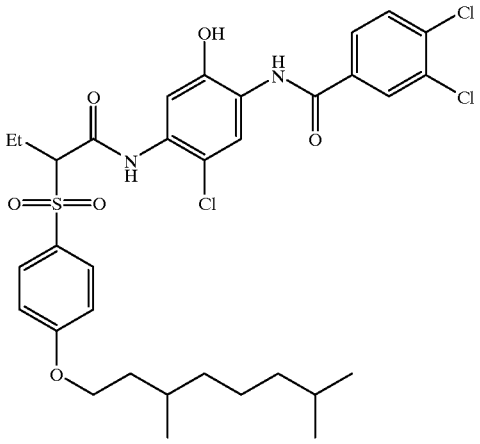

-continued

CC-3

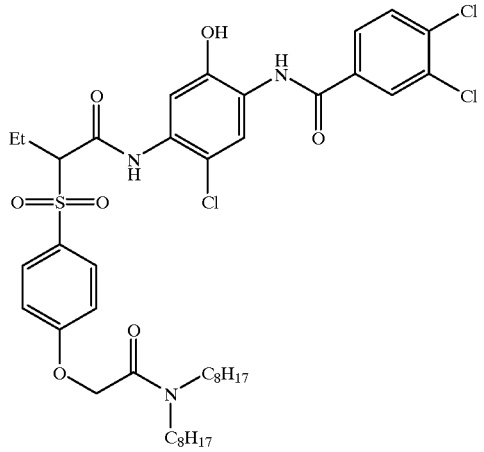

CC-4

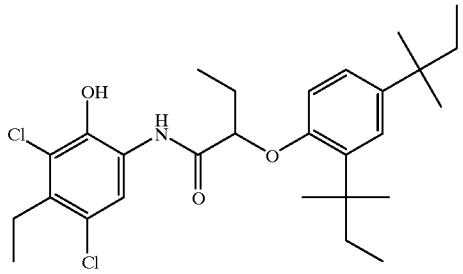

CC-5

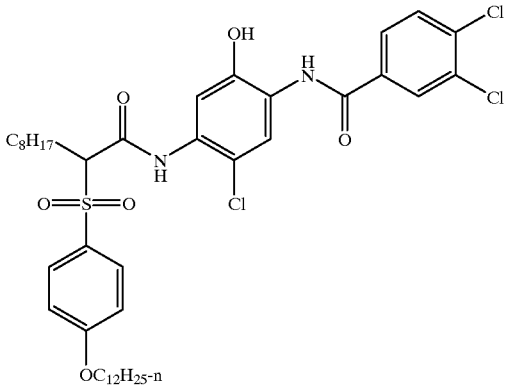

CC-6

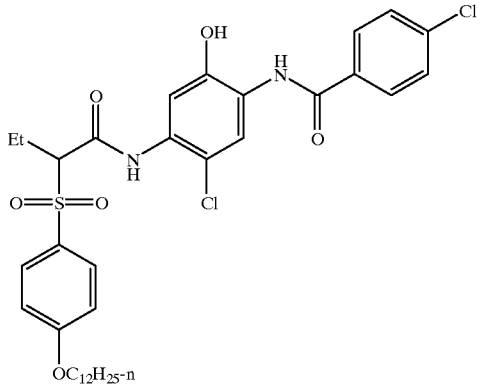

-continued

CC-7

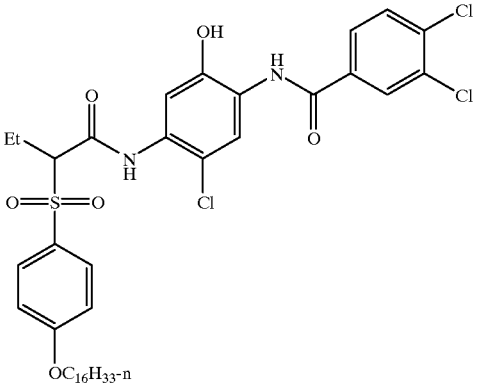

Crystal Example

Dispersion III-1 was prepared by combining a solution of 4.6 g of Coupler IC-1, 9.3 g of ST-1 and 9.3 g of dibutylsebecate at 150° C. with an 80° C. solution consisting of 9.0 g decalcified gelatin, 109.5 g de-mineralized water, and 9.0 g of a 10% solution of surfactant Alkanol XC (trademark of E. I. Dupont Co.). This combined solution was mixed for one minute at 8000 rpm using a Brinkmann rotor-stator mixer, then homogenized via 2 passes through a Microfluidics Microfluidizer at 562.5 kg/cm$^2$, 80° C. to produce Dispersion III-1. This dispersion was then placed in cold storage until ready for combination with a light-sensitive photographic emulsion in a photographic element.

Dispersion III-2was prepared as Dispersion III-1, except replacing coupler CC-1 with coupler CC-7.

Dispersion III-3 was prepared as Dispersion III-1, except with 4.1 g of coupler CC-1 and 0.5 g of coupler CC-7.

Dispersion III-4 was prepared similarly to Dispersion 4-3 by combining a solution of 33.4 g of Coupler CC-1, 3.7 g of Coupler CC-7, 75.2 g of ST-1 and 75.2 g of dibutylsebecate at 130° C. for 10 minutes with an 80° C. solution consisting of 75.0 g decalcified gelatin, 912.5 g de-mineralized water, and 75.0 g of a 10% solution of surfactant Alkanol XC (trademark of E. I. Dupont Co.). This combined solution was mixed for one minute at 8000 rpm using a Brinkmann rotor-stator mixer, then homogenized via 2 passes through a Microfluidics Microfluidizer at 562.5 kg/cm$^2$ (8000 psi), 75° C. to produce Dispersion III-4.

Dispersion 4-5 was prepared similarly to Dispersion 4-4 by combining a solution of 41.6 g of Coupler IC-1, 84.2 g of ST-1 and 84.2 g of dibutylsebecate at 145° C. for 10 minutes with an 80° C. solution consisting of 84.0 g decalcified gelatin, 1019.0 g de-mineralized water, 3.0 g of a 0.7% solution of Kathon LX™, and 84.0 g of a 10% solution of surfactant Alkanol XC (trademark of E. I. Dupont Co.). This combined solution was mixed for one minute at 8000 rpm using a Brinkmann rotor-stator mixer, then homogenized via 2 passes through a Microfluidics Microfluidizer at 562.5 kg/cm$^2$ (8000 psi), 75° C. to produce Dispersion III-5.

To evaluate the amount of crystalline material in each dispersion, samples of Dispersions 4-1 through 4-4 were examined via cross-polar microscopy at 98× magnification after storage of the dispersions at 5° C. for 24 hours. Thermal prints were made using a Kodak 450GL Digital Color Printer and the number of crystals observed in the approximately 86 mm×117 mm area of the photograph were counted and are reported in Table III.

Table III

| Dispersion | Coupler 1 | Coupler 2 | % Coupler 2 | Crystals |
|---|---|---|---|---|
| III-1 | CC-1 | — | 0% | 330 |
| III-2 | CC-7 | — | 0% | >400 |
| III-3 | CC-1 | CC-7 | 10% | 45 |
| III-4 | CC-1 | CC-7 | 10% | 65 |
| III-5 | IC-1 | — | 0% | 8 |

High melting couplers CC-1 and CC-7 are difficult to disperse, as shown by the high number of crystals in dispersions III-1 and III-2. However, the combination of these homologous couplers in a ratio 9:1 CC-1: CC-7 results in a significant reduction in crystals, as in dispersion III-3 and III-4. To use coupler CC-1, it must be combined with CC-7. Coupler of the inventi on IC-1 is dispersed easily as in Dispersion III-5, resulting in a dispersion nearly fiee of crystals. Dispersion III-5 was coated in a multilayer photographic element exhibiting good reactivity, dye stability to light and heat, and desirable hue, advantaged to dispersions like III-3 and III-4, since only one coupler was necessary.

The entire contents of the patents and other publications cited in this specification are incorporated herein by reference.

What is claimed is:

1. A photographic element comprising a light sensitive silver halide emulsion layer having associated therewith a cyan dye foiming coupler having Formula (I):

(I)

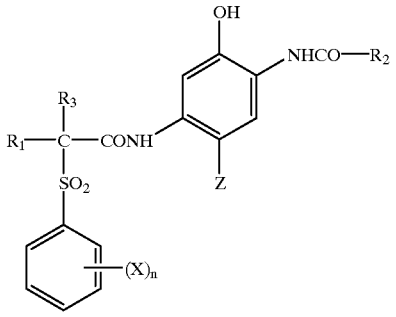

wherein $R_1$ and $R_3$ independently represent hydrogen or an alkyl group;

$R_2$ represents a carbocyclic or heterocyclic aromatic group;

n represents 1, 2, or 3;

each X is an independently selected substituent where at least one X located at a position of the phenyl ring meta or para to the sulfonyl group and is either an alkoxy group having a branched carbon or an aiyloxy group; and Z represents hydrogen or a group that can be split off by the reaction of the coupler with an oxidized color-developing compound;

provided that the substituents of the compound of formula (I) are selected so that the compound has a melting point of 160° C. or less.

2. The element of claim 1 wherein $R_3$ represents hydrogen.

3. The element of claim 2 wherein $R_1$ represents hydrogen.

4. The element of claim 2 wherein $R_1$ represents a C1–C4 alkyl group.

5. The element of claim 1 wherein $R_1$ represents a C1–C4 alkyl group.

6. The element of claim 1 wherein $R_2$ represents a phenyl or naphthyl group.

7. The element of claim 6 wherein $R_2$ represents a phenyl group bearing a substituent located in a position meta or para to the amido group and having a positive Hammett's sigma value relative to the position of the amido group.

8. The element of claim 7 wherein $R_2$ contains at least one substituent selected from chloro, cyano, fluoro, sulfonyl, and sulphonamido groups.

9. The element of claim 8 wherein $R_2$ is selected from the group consisting of a 4-chlorophenyl, 3,4-dichlorophenyl, 4-cyanophenyl, 3-chloro-4-cyanophenyl, pentafluorophenyl, and 4-sulfonamidophenyl.

10. The element of claim 1 wherein at least one X is an alkoxy group.

11. The element of claim 10 wherein said alkoxy group is branched at the β carbon.

12. The element of claim 1 wherein said at least one X is an aryloxy group.

13. The element of claim 1 wherein Z is hydrogen.

14. The element of claim 1 wherein Z is a group which can be split off by the reaction of the coupler with an oxidized color-developing compound.

15. The element of claim 14 wherein Z is selected fiom the group consisting of halogen, alyloxy, alkoxy, arylthio, alkylthio, and heterocyclic groups.

16. The element of claim 1 wherein $R_1$ is selected from the group consisting of methyl, ethyl, n-propyl, and isopropyl.

17. The element of claim 1 wherein the compound of formula I is present as a dispersion in an organic solvent.

18. The element of claim 1 wherein the substituents of the compound of formula (I) are selected so that the compound has a melting point of 150° C. or less.

19. The element of claim 17 wherein the solvent is dibutyl sebacate.

20. The element of claim 1 wherein the element comprises a reflective support.

21. A process for foiming an image in an element as descilbed in claim 1 after the element has been imagewise exposed to light comprising contacting the element with a color-developing compound.

* * * * *